US005685683A

United States Patent [19]

Becker et al.

[11] Patent Number: 5,685,683

[45] Date of Patent: Nov. 11, 1997

[54] BULK-SHIP UNLOADING SYSTEM

[75] Inventors: Hans Jürgen Becker, Quierschied; Franz Maria Wolpers, Saarbrücken; Karl-Friedrich Göttel, St. Ingbert, all of Germany

[73] Assignee: PWH Anlagen+Systeme GmbH, St. Ingbert, Germany

[21] Appl. No.: 508,935

[22] Filed: Jul. 28, 1995

[30] Foreign Application Priority Data

Aug. 2, 1994 [DE] Germany ..... 44 27 345.2

[51] Int. Cl.[6] ..... B65G 63/02

[52] U.S. Cl. ..... 414/141.1; 414/138.7; 414/139.6; 414/140.3; 414/786

[58] Field of Search ..... 414/138.7, 138.8, 414/139.1, 139.3, 139.6, 139.7, 140.3, 141.3, 141.4, 142.1, 142.2, 142.5, 141.1, 786

[56] References Cited

U.S. PATENT DOCUMENTS

| | | | |
|---|---|---|---|
| 3,356,232 | 12/1967 | Price et al. | 414/138.7 |
| 3,362,546 | 1/1968 | Sale | 414/139.1 |
| 4,477,220 | 10/1984 | Greenwald, Sr. et al. | 414/138.8 |

FOREIGN PATENT DOCUMENTS

| | | | |
|---|---|---|---|
| 1534928 | 8/1968 | France | 414/139.1 |
| 27 20 506 | 7/1978 | Germany . | |
| 32 04 177 | 9/1982 | Germany . | |
| 43 10 656 | 12/1993 | Germany . | |
| 190121 | 10/1984 | Japan | 414/138.8 |

*Primary Examiner*—Karen B. Merritt
*Assistant Examiner*—Gregory A. Morse
*Attorney, Agent, or Firm*—Herbert Dubno; Andrew Wilford

[57] ABSTRACT

Bulk material is unloaded with a bucket conveyor from a ship floating in a body of water by first positioning the ship in the body of water between a stationary land-fixed location and a float spaced transversely therefrom. An outer intake end of a pivotal bulk conveyor on the float is supported at a fixed height above the body of water adjacent the ship and an opposite inner outlet end of the pivotal bulk conveyor at a fixed height above the stationary location. The pivotal bulk conveyor is swung about a horizontal axis to maintain the heights constant as the level of the body of water changes so that as the water level changes the angle of the pivotal bulk conveyor to the horizontal changes. The bulk material is picked out of the ship with the bucket conveyor, is then passed to the pivotal bulk conveyor and fed along the pivotal bulk conveyor to the outlet end thereof. Both of the conveyors are moved longitudinally along the ship perpendicular to the pivotal bulk conveyor as the material is picked out of the ship and the material is discharged from the outlet end of the pivotal bulk conveyor into a bunker car and thence to a longitudinally extending land conveyor. The bunker car is moved synchronously longitudinally with the pivotal bulk conveyor and bucket conveyor.

11 Claims, 4 Drawing Sheets

BULK-SHIP UNLOADING SYSTEM

FIELD OF THE INVENTION

The present invention relates to ship-unloading system. More particularly this invention concerns a system for unloading bulk material from a ship.

BACKGROUND OF THE INVENTION

In unloading bulk material, such as coal, ore, gravel, or garbage, from a ship, such as a barge, bulk carrier, or lighter, it is normally necessary to pull the ship up next to a land-based dock and pick out the ship's contents by means of a land-mounted crane. This system works quite well when the level of the body of water does not change much with respect to the land.

When, however, the level of the body of water, for instance a tidal estuary, varies substantially, such a procedure can become fairly difficult and slow, in particular when the water level is low and the crane or unloading conveyor must dip down deeply to get into the ship.

Accordingly it has been suggested in German patent documents 2,720,506 of Valmet, 3,204,177 of Bos, and 4,310,656 of Rohr to mount the unloading equipment on a float or pontoon assembly so that it will always be at the same level with respect to the body of water. Such an arrangement represents a modest improvement and simplification and can work with level differences up to about 5 m, but still requires that the crane or unloading conveyor displace the material through an inordinate distance under some circumstances.

These systems are particularly disadvantageous at low water levels because the unloading time is increased excessively. Thus docking fees and the like are increased as is the turnaround time for the vessel.

OBJECTS OF THE INVENTION

It is therefore an object of the present invention to provide an improved bulk-ship unloading system.

Another object is the provision of such an improved bulk-ship unloading method and apparatus which overcome the above-given disadvantages, that is which operates quickly and efficiently regardless of the level of the water, even at level variations to 10 m.

SUMMARY OF THE INVENTION

Bulk material is unloaded with a bucket conveyor from a ship floating in a body of water by first positioning the ship in the body of water between a stationary land-fixed location and a float spaced transversely therefrom. An outer intake end of a pivotal bulk conveyor on the float is supported at a fixed height above the body of water adjacent the ship and an opposite inner outlet end of the pivotal bulk conveyor at a fixed height above the stationary location. The pivotal bulk conveyor is swung about a horizontal axis to maintain the heights constant as the level of the body of water changes so that as the water level changes the angle of the pivotal bulk conveyor to the horizontal changes. The bulk material is picked out of the ship with the bucket conveyor, is then passed to the pivotal bulk conveyor and fed along the pivotal bulk conveyor to the outlet end thereof. Both of the conveyors are moved longitudinally along the ship perpendicular to the pivotal bulk conveyor as the material is picked out of the ship and the material is discharged from the outlet end of the pivotal bulk conveyor into a bunker car and thence to a longitudinally extending land conveyor. The bunker car is moved synchronously longitudinally with the pivotal bulk conveyor and bucket conveyor.

Thus with this system the path along which the bulk material is moved is of the same general length regardless of the vertical position of the ship relative to the land. Admittedly when the ship sits lower the material will be lifted a greater distance, but it will still move along the same path so that while the energy needed to unload the ship may vary, the time needed will not.

According to another feature of the invention the bulk material is conveyed horizontally transversely away from the land location from an outlet end of the bucket conveyor and then the bulk material is conveyed horizontally and longitudinally to the outer end of the pivotal bulk conveyor. Thus the material moves along the full length of the pivotal bulk conveyor regardless of its inclination. These conveyors between the bucket conveyor and the pivotal bulk conveyor can be vibratory-trough conveyors.

The pivotal bulk conveyor according to the invention is pivoted in accordance with the level of the body of water relative to the land location. Sensors are provided for detecting the level of the land relative to the level of the float, and their output is used to set the angle of the pivotal conveyor. Similarly the longitudinal position of the outlet end of the pivotal bulk conveyor is sensed and the bunker car is moved longitudinally in accordance with the sensed longitudinal position of the outlet end. Thus the bunker car always is exactly positioned under the outlet end of the pivotal bulk conveyor, which typically is a belt or skip-type conveyor.

The ship can have an overall length substantially longer than a maximum possible longitudinal displacement of the pivotal bulk conveyor from a starting position to an ending position thereof. Thus once the pivotal bulk conveyor has reached its ending position the ship is displaced longitudinally backward through a distance generally equal to the maximum displacement of the pivotal bulk conveyor, the pivotal bulk conveyor is returned to its starting position, and thereafter the pivotal bulk conveyor is moved with the bucket conveyor toward its ending position while picking up more material from the ship. The ship here can actually be formed by a series of joined barges or lighters that, therefore, do not need to be disconnected for unloading. The ship can be moved by a land-mounted winch, or by a tug.

Normally the float is an anchored pontoon that cannot move relative to the land location which is a dock or quay. More specifically it includes a pair of transversely spaced and transversely interconnected pontoons flanking the ship. The pivot axis is at the outer end of the pivotal bulk conveyor.

It is further possible to have two separate bucket conveyors so that two ships can be unloaded simultaneously. These bucket conveyors can both discharge onto the same horizontal conveyor feeding to the same pivotal conveyor so that capacity is doubled without having to duplicate all the equipment.

Since all that need be provided at dock side is a horizontal conveyor and the bunker car, this system can be retrofitted to a port with relatively limited space. In fact the horizontal conveyor and track for the bunker car can be provided on a pile-supported dock of relatively narrow width.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
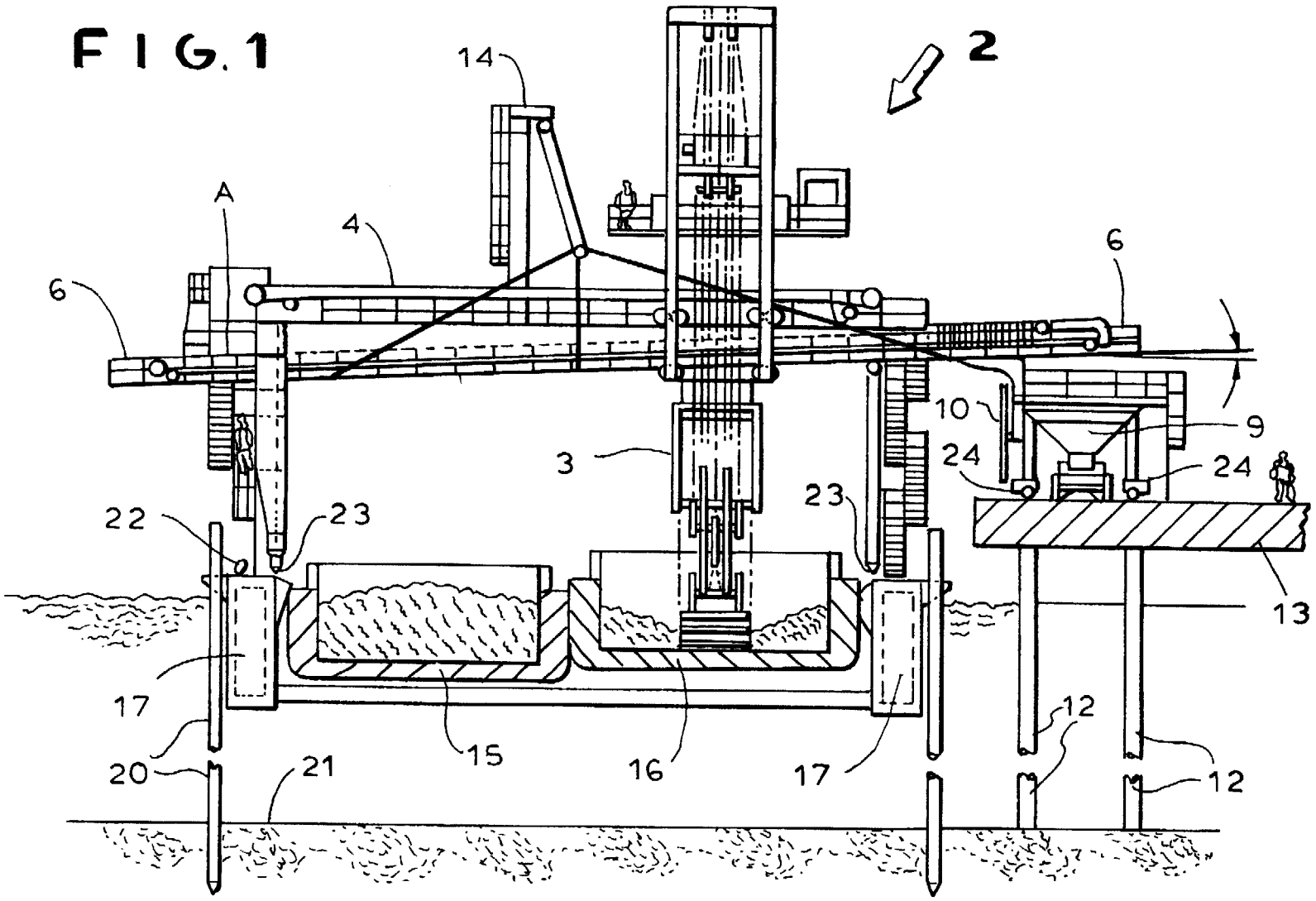
FIG. 1 is a partly diagrammatic small-scale vertical section through the unloading system of this invention.
Figure 2:
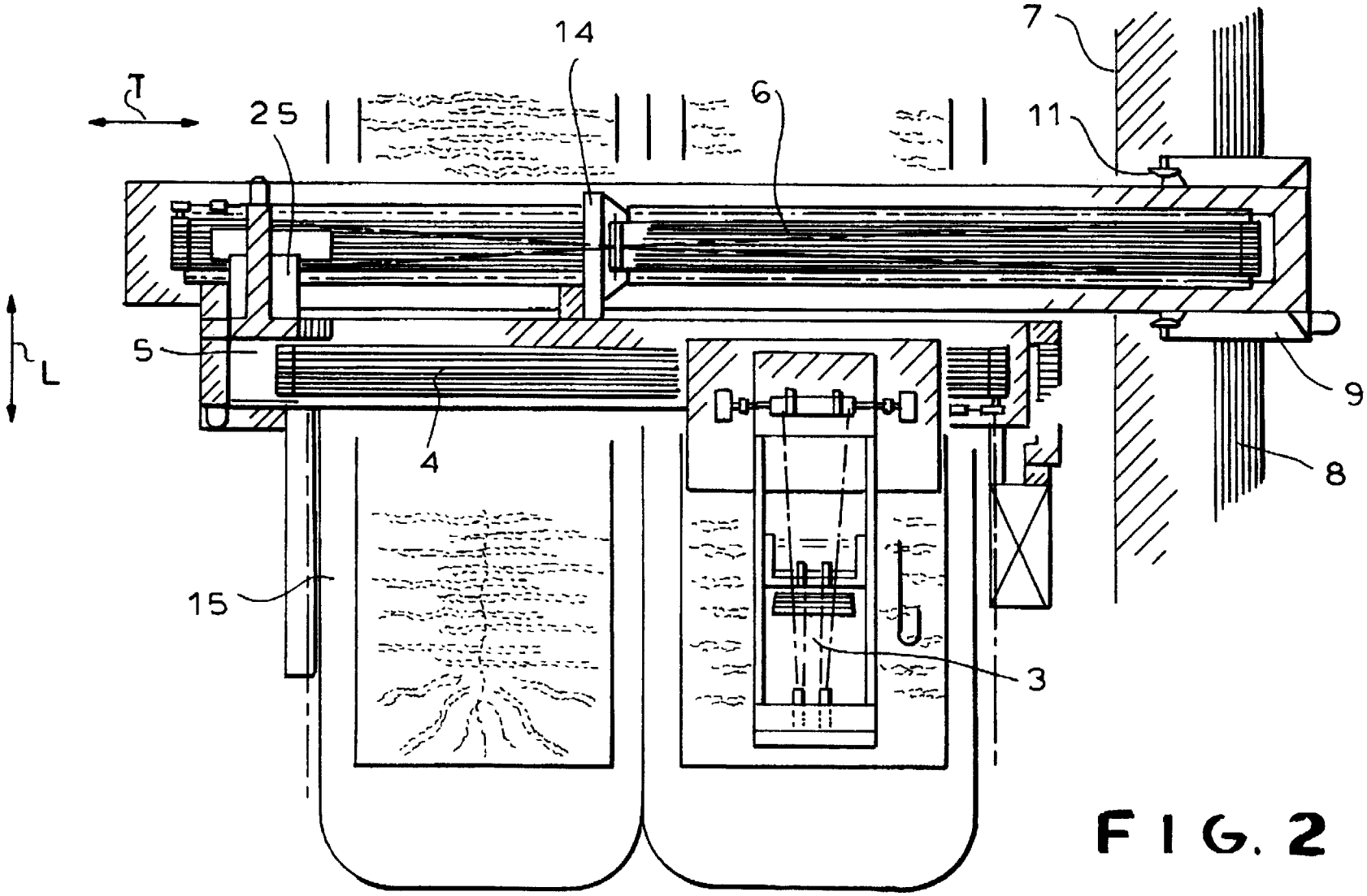
FIG. 2 is a top view of the structure of FIG. 1.
Figure 3:
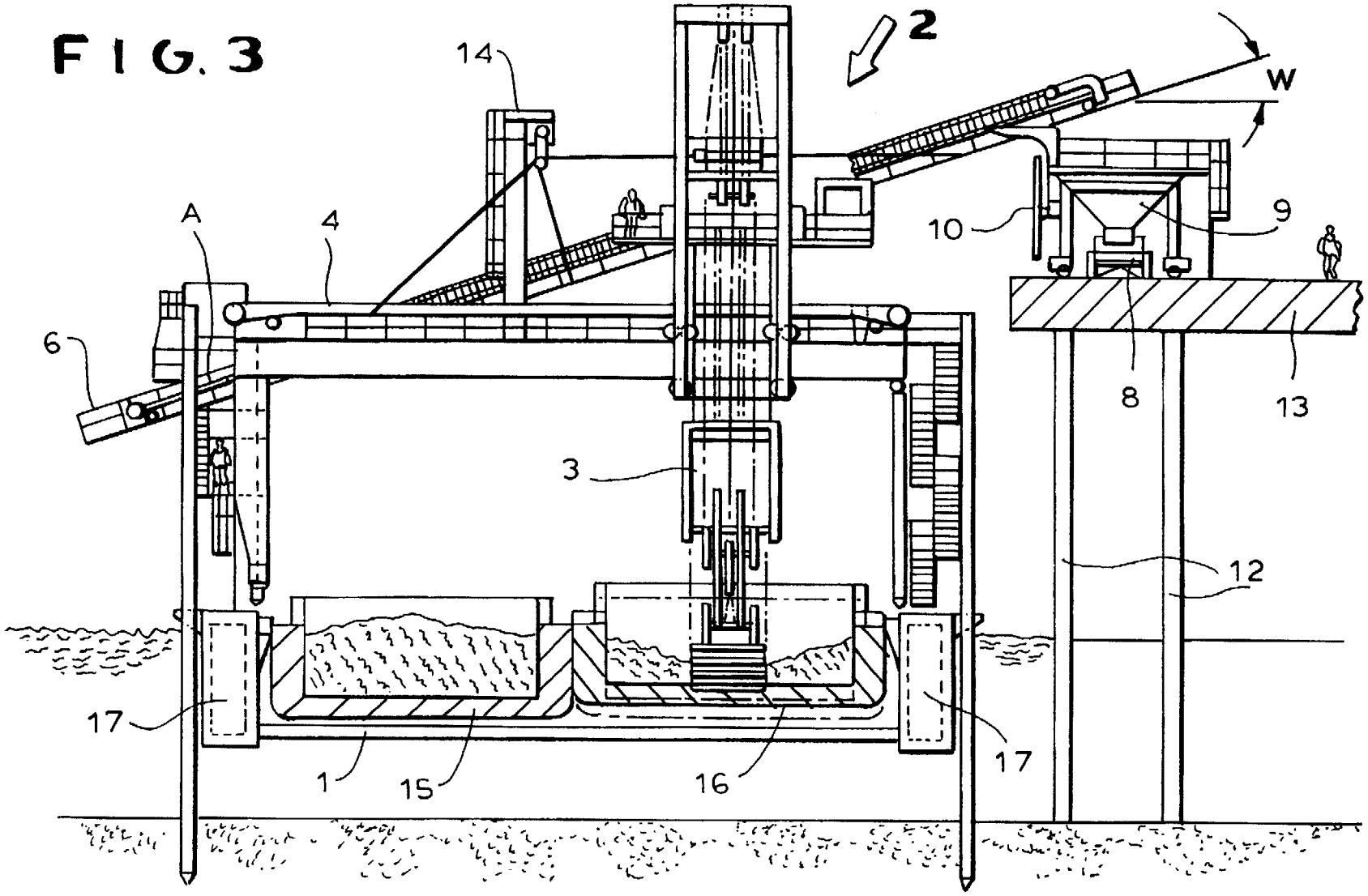
FIG. 3 is a view like FIG. 1 but in low-water conditions.

As seen in FIGS. 1 through 3 a float 1 having a pair of longitudinally extending pontoons 17 is secured in place by vertical piles 20 set in the bottom 21 so it can move vertically between the high-water position of FIG. 1 and the low-water position of FIG. 3. This float is wide enough in a transverse direction T to accommodate two ships, here barges 15 and 16, side by side with each ship 15 and 16 having an overall length in a longitudinal direction L that is at least twice the longitudinal length of the float 1.

Figure 4:
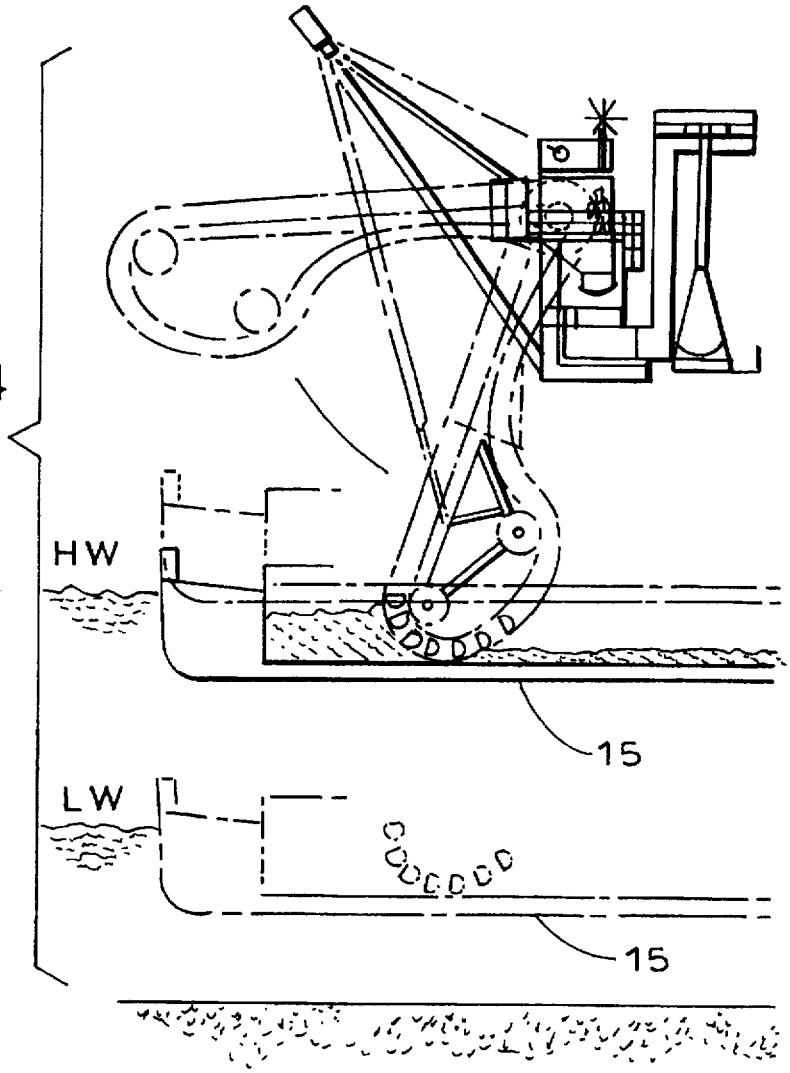
FIG. 4 is a detail view illustrating operation of the bucket conveyor of the unloading system.

Supported on this float 1 is a conveyor assembly 2 comprising a conventional bucket conveyor 3 that can dip into either of the ships 15 or 16, a horizontal conveyor 4 extending transversely the full width of the float 1 above the ships 15 and 16, a short longitudinally extending horizontal conveyor 5 and a pivotal or angle conveyor 6. The bucket conveyor 3 is of the type shown in FIG. 4 which can be dropped down to scoop up and transport up bulk material, here coal and that can move transversely across the system. The conveyors 4 and 5 can be of the vibratory trough type. The conveyor 6 is a belt conveyor and is suspended by a device 14 that can pivot it about an axis A on the outboard side of the float 1 in accordance with water depth as detected by sensors 22 that can read this depth off the piles 20. The entire conveyor assembly 2 can be moved longitudinally on tracks 23 along the float by a drive 25 (FIG. 2).

Figure 5:
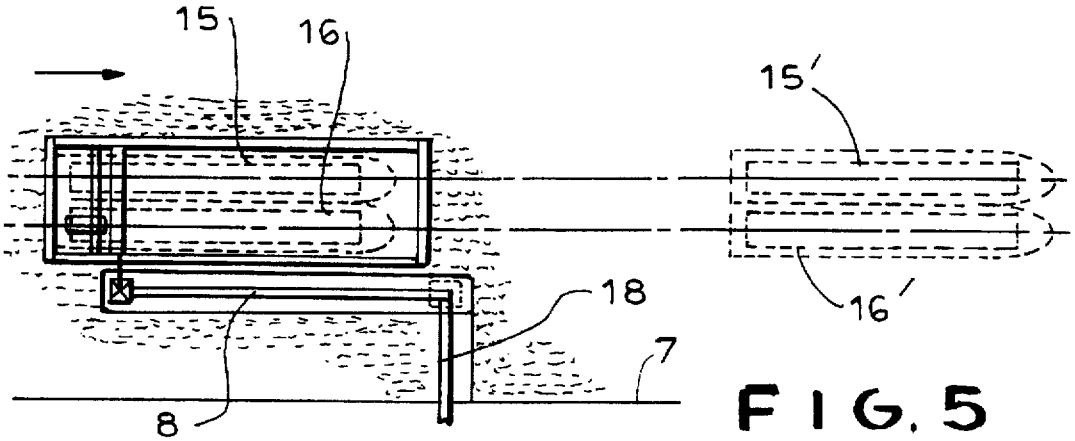
FIG. 5 is a small-scale top view illustrating another aspect of the invention.

The float 1 is provided either adjacent a platform or dock 13 mounted to the land bottom 21 by piles 12 or next to the shore 7 (FIG. 5). The outlet end of the conveyor 6 is above a shore- or dock-mounted longitudinal belt conveyor 8 above which is a funnel-like bunker car 9 that straddles the conveyor 8 and rides on longitudinal tracks 24 transversely flanking it. This car 9 is provided with sensors 11 that detect the position of the conveyor 6 and operate a drive 10 of the car 9 to keep it under the outlet end of the conveyor 6. A transverse conveyor 18 (FIG. 5) is provided at the outlet end of the land-based conveyor 8.

Thus the bucket conveyor 3 scoops material out of one of the ships 15 or 16 and moves it up and deposits it on the horizontal conveyor 4 which transports the material outward (to the left in FIGS. 1 and 3) and deposits it onto the conveyor 5. From the conveyor 5 the material is dumped onto the intake end of the conveyor 6 which moves it back upward and inward (to the right in FIGS. 1 and 3) until it drops down into the bunker car 9 and then onto the conveyor 8. As the ship 15 or 16 is emptied the drive 25 moves the entire conveyor assembly 2 longitudinally, and the bunker car 9 automatically follows this movement.

When the end of the longitudinal travel of the conveyor assembly 2 is reached a tug or winch is used to move the ships 15 and 16 longitudinally backward while the drive 25 is reversed so that the conveyor 3 can take another cut at the pile of material in the ship 15 or 16. A second such conveyor 3 can be provided to empty two ships simultaneously.

FIG. 5 shows how four such ships 15, 16, 15', and 16' can be serviced by the system. This is done by moving them through the float 1 in steps.

As the water level changes and the float 1 moves up and down relative to the dock 13 or bank 7, the drive device 14 automatically pivots the conveyor 6 appropriately so that its upper or outlet end is always just above the level of the horizontally moving bunker car 9. Due to the length of the conveyor 6, substantial variations in depth, up to 10 m, are easily accommodated with no loss in unloading speed.

We claim:

1. A method of unloading bulk material with a bucket conveyor from a ship floating in a body of water, the method comprising the steps of:

positioning the ship in the body of water between a stationary land-fixed location and a float spaced transversely therefrom relative to a longitudinal direction generally parallel to the ship and retaining the ship against longitudinal movement;

supporting an outer intake end of a pivotal bulk conveyor on the float at a fixed height above the body of water adjacent the ship and an opposite inner outlet end of the pivotal bulk conveyor at a fixed height above the stationary location;

pivoting the pivotal bulk conveyor about a horizontal and longitudinal axis to maintain the heights constant as the level of the body of water changes, whereby as the water level changes the angle of the pivotal bulk conveyor to the horizontal changes;

picking the bulk material out of the ship with the bucket conveyor, passing the picked-out material to the bulk conveyor, and feeding the picked-out material along the pivotal bulk conveyor transversely to the outlet end thereof;

while maintaining the ship against longitudinal movement displacing both of the conveyors longitudinally along the ship perpendicular to the pivotal bulk conveyor as the material is picked out of the ship;

discharging the material from the outlet end of the pivotal bulk conveyor into a bunker car and thence to a longitudinally extending land conveyor; and moving the bunker car synchronously longitudinally with the pivotal bulk conveyor and bucket conveyor.

2. The bulk-ship unloading method defined in claim 1 wherein the pivotal bulk conveyor is pivoted in accordance with the level of the body of water relative to the land location.

3. A method of unloading bulk material with a bucket conveyor from a ship floating in a body of water, the method comprising the steps of:

positioning and anchoring the ship in the body of water between a stationary land-fixed location and a float spaced transversely therefrom relative to a longitudinal direction generally parallel to the ship;

supporting an outer intake end of a pivotal bulk conveyor on the float at a fixed height above the body of water adjacent the ship and an opposite inner outlet end of the pivotal bulk conveyor at a fixed height above the stationary location;

pivoting the pivotal bulk conveyor about a horizontal and longitudinal axis to maintain the heights constant as the level of the body of water changes, whereby as the water level changes the angle of the pivotal bulk conveyor to the horizontal changes;

sequentially picking the bulk material out of the ship with the bucket conveyor, conveying the bulk material horizontally transversely away from the land location from an outlet end of the bucket conveyor, conveying the bulk material horizontally longitudinally to the outer end of the pivotal bulk conveyor, and feeding the picked-out material along the pivotal bulk conveyor transversely to the outlet end thereof;

displacing both of the conveyors longitudinally along the ship perpendicular to the pivotal bulk conveyor as the material is picked out of the ship;

discharging the material from the outlet end of the pivotal bulk conveyor into a bunker car and thence to a longitudinally extending land conveyor; and moving the bunker car synchronously longitudinally with the pivotal bulk conveyor and bucket conveyor.

4. A method of unloading bulk material with a bucket conveyor from a ship floating in a body of water, the method comprising the steps of:

positioning and anchoring the ship in the body of water between a stationary land-fixed location and a float spaced transversely therefrom relative to a longitudinal direction generally parallel to the ship;

supporting an outer intake end of a pivotal bulk conveyor on the float at a fixed height above the body of water adjacent the ship and an opposite inner outlet end of the pivotal bulk conveyor at a fixed height above the stationary location;

pivoting the pivotal bulk conveyor about a horizontal and longitudinal axis to maintain the heights constant as the level of the body of water changes, whereby as the water level changes the angle of the pivotal bulk conveyor to the horizontal changes;

picking the bulk material out of the ship with the bucket conveyor, passing the picked-out material to the bulk conveyor, and feeding the picked-out material along the pivotal bulk conveyor transversely to the outlet end thereof;

displacing both of the conveyors longitudinally along the ship perpendicular to the pivotal bulk conveyor as the material is picked out of the ship;

discharging the material from the outlet end of the pivotal bulk conveyor into a bunker car and thence to a longitudinally extending land conveyor;

moving the bunker car synchronously longitudinally with the pivotal bulk conveyor and bucket conveyor;

sensing the longitudinal position of the outlet end of the pivotal bulk conveyor relative to the land-fixed location; and displacing the bunker car longitudinally on the land-fixed location in accordance with the sensed longitudinal position of the outlet end.

5. A method of unloading bulk material with a bucket conveyor from a ship floating in a body of water, the method comprising the steps of:

positioning and anchoring the ship in the body of water between a stationary land-fixed location and a float spaced transversely therefrom relative to a longitudinal direction generally parallel to the ship;

supporting an outer intake end of a pivotal bulk conveyor on the float at a fixed height above the body of water adjacent the ship and an opposite inner outlet end of the pivotal bulk conveyor at a fixed height above the stationary location, the ship having an overall length measured parallel to the longitudinal direction substantially longer than a maximum possible longitudinal displacement of the pivotal bulk conveyor from a starting position to an ending position thereof pivoting the pivotal bulk conveyor about a horizontal and longitudinal axis to maintain the heights constant as the level of the body of water changes, whereby as the water level changes the angle of the pivotal bulk conveyor to the horizontal changes;

picking the bulk material out of the ship with the bucket conveyor, passing the picked-out material to the bulk conveyor, and feeding the picked-out material along the pivotal bulk conveyor transversely to the outlet end thereof;

displacing both of the conveyors longitudinally along the ship perpendicular to the pivotal bulk conveyor as the material is picked out of the ship;

discharging the material from the outlet end of the pivotal bulk conveyor into a bunker car and thence to a longitudinally extending land conveyor:

moving the bunker car synchronously longitudinally with the pivotal bulk conveyor and bucket conveyor; and once the pivotal bulk conveyor has reached its ending position displacing the ship longitudinally backward through a distance generally equal to the maximum displacement of the pivotal bulk conveyor;

returning the pivotal bulk conveyor to its starting position; and thereafter moving the pivotal bulk conveyor with the bucket conveyor toward its ending position while picking up more material from the ship.

6. A method of unloading bulk material with a bucket conveyor from a ship floating in a body of water, the method comprising the steps of:

positioning the ship in the body of water between a stationary land-fixed location and a float spaced transversely therefrom relative to a longitudinal direction and retaining the ship against longitudinal movement;

supporting an outer intake end of a pivotal bulk conveyor on the float at a fixed height above the body of water adjacent the ship and supporting an opposite inner outlet end of the pivotal bulk conveyor at a fixed height above the stationary location;

pivoting the pivotal bulk conveyor about a horizontal and longitudinal axis to maintain the heights generally constant as the level of the body of water changes, whereby as the water level changes the angle of the pivotal bulk conveyor to the horizontal changes;

picking the bulk material out of the ship with the bucket conveyor, passing the picked-out material to the outer intake end of the bulk conveyor, and feeding the picked-out material along the pivotal bulk conveyor to the outlet end thereof;

while maintaining the ship against longitudinal movement displacing both of the conveyors longitudinally along the ship perpendicular to the pivotal bulk conveyor as the material is picked out of the ship; and discharging the material from the outlet end of the pivotal bulk conveyor onto a longitudinally extending land conveyor.

7. A system for unloading bulk material from a ship floating in a body of water, the system comprising:

a float riding on the body of water spaced transversely from a land-fixed location relative to a longitudinal direction generally parallel to the ship, the ship being anchored in the body of water between the transversely spaced location and the float;

a transversely extending bulk conveyor having an outer intake end above the float and an inner outlet end above the location;

a longitudinally displaceable bunker car on the land location;

a longitudinally extending conveyor on the land location underneath the bunker car;

means for supporting the outer intake end on the float at a fixed height above the body of water adjacent the ship and the inner outlet end at a fixed height above the stationary location and for pivoting the pivotal bulk conveyor about a horizontal and longitudinal axis to maintain the heights constant as the level of the body of water changes, whereby as the water level changes the angle of the pivotal bulk conveyor to the horizontal changes;

conveyor means including a bucket conveyor for picking the bulk material out of the ship, passing the picked-out material to the pivotal bulk conveyor, feeding the picked-out material along the pivotal bulk conveyor to the outlet end thereof, and discharging the material from the outlet end of the pivotal bulk conveyor into the bunker car and thence to a longitudinally extending land conveyor; and means moving the bunker car synchronously longitudinally with the pivotal bulk conveyor and bucket conveyor.

8. The system defined in claim 7 wherein the float includes a pair of transversely spaced and transversely interconnected pontoons flanking the ship.

9. The system defined in claim 7 wherein the axis is at the outer end of the pivotal bulk conveyor.

10. The system defined in claim 7 wherein the conveyor means further includes a transversely extending and horizontal lower bulk conveyor receiving material from the bucket conveyor and displacing it transversely and horizontally outward away from the location; and a longitudinally extending and horizontal bulk conveyor receiving material from the transverse horizontal conveyor and displacing it horizontally and longitudinally to the outer end of the pivotal bulk conveyor.

11. The system defined in claim 7, further comprising;

sensors for detecting the longitudinal position of the outlet end of the pivotal bulk conveyor and generating an output corresponding thereto, whereby the output is used to control the longitudinal position of the bunker car.

* * * * *